US007445501B1

(12) United States Patent
Amidon et al.

(10) Patent No.: US 7,445,501 B1
(45) Date of Patent: Nov. 4, 2008

(54) INSULATOR FOR A COAXIAL CABLE CONNECTOR AND METHOD OF USE THEREOF

(75) Inventors: Jeremy Amidon, Marcellus, NY (US); Shawn Chawgo, Cicero, NY (US)

(73) Assignee: John Mezzalingua Assoc., Inc., East Syracuse, NY (US)

( * ) Notice: Subject to any disclaimer, the term of this patent is extended or adjusted under 35 U.S.C. 154(b) by 7 days.

(21) Appl. No.: 11/759,964

(22) Filed: Jun. 8, 2007

(51) Int. Cl.
*H01R 9/05* (2006.01)

(52) U.S. Cl. ..... 439/583

(58) Field of Classification Search ..... 439/578, 439/584, 585, 63
See application file for complete search history.

(56) References Cited

U.S. PATENT DOCUMENTS

| | | | | |
|---|---|---|---|---|
| 3,196,382 | A | 7/1965 | Morello, Jr. | |
| 3,264,602 | A | 8/1966 | Schwartz | |
| 3,710,005 | A | 1/1973 | French | |
| 3,740,453 | A | 6/1973 | Callaghan et al. | |
| 3,781,762 | A | 12/1973 | Quackenbush | |
| 3,963,321 | A | 6/1976 | Burger et al. | |
| 4,053,200 | A | 10/1977 | Pugner | |
| 4,173,385 | A | 11/1979 | Fenn et al. | |
| 4,583,811 | A | 4/1986 | McMills et al. | |
| 4,674,818 | A | 6/1987 | McMills et al. | |
| 5,002,503 | A | 3/1991 | Campbell et al. | |
| 5,127,853 | A | 7/1992 | McMills et al. | |
| 5,183,411 | A * | 2/1993 | Yu | 439/578 |
| 5,342,218 | A | 8/1994 | McMills et al. | |
| 6,210,222 | B1 | 4/2001 | Langham et al. | |
| 6,352,448 | B1 | 3/2002 | Holliday et al. | |
| 6,692,299 | B1 * | 2/2004 | Stockmaster | 439/578 |
| 6,790,081 | B2 * | 9/2004 | Burris et al. | 439/578 |
| 7,048,578 | B2 | 5/2006 | Rodrigues | |
| 7,048,579 | B2 | 5/2006 | Montena | |
| 2006/0046565 | A1 | 3/2006 | Hosler, Sr. | |

FOREIGN PATENT DOCUMENTS

| | | |
|---|---|---|
| EP | 0997988 A2 | 5/2000 |

* cited by examiner

*Primary Examiner*—Jean F Duverne
(74) *Attorney, Agent, or Firm*—Melissa Bitting

(57) ABSTRACT

An insulator for coaxial cable connectors, the insulator is disposed within a coaxial cable connector and contains an insulator passageway. The insulator has a guide surface at one end. As the prepared end of a coaxial cable is inserted into the insulator passageway, the guide surface engages the dielectric of the cable and radially diverts the conductive foil sheath away from the center conductor of the cable.

22 Claims, 8 Drawing Sheets

FIGS. 8-8D
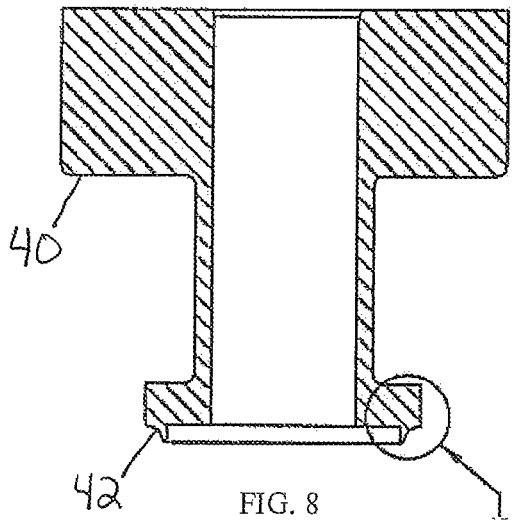
FIG. 8
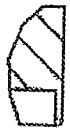
FIG. 8C
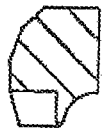
FIG. 8A
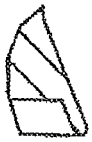
FIG. 8D
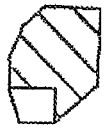
FIG. 8B

INSULATOR FOR A COAXIAL CABLE CONNECTOR AND METHOD OF USE THEREOF

FIELD OF THE INVENTION

The invention relates to coaxial cable connectors, and more specifically, to an improved insulator for a coaxial cable connector and a method of use thereof.

BACKGROUND OF THE INVENTION

The use of coaxial cable for video and data transfer is rapidly increasing. Such cables typically include a center, inner conductor surrounded by a low dielectric constant plastic foam. An outer conductor is typically bonded to the outer surface of and thereby contains the dielectric. The outer conductor may comprise a sheath of fine braided metallic strands, a metallic foil, or multiple layer combinations of either or both. A protective insulating jacket, or sheath surrounds the outer conductor and helps prevent moisture from degrading the signal path. The ends of such coaxial cables must be connected to junction boxes, amplifiers, coaxial ports and the like and coaxial connectors are well known for terminating the ends of coaxial cables.

In order to properly transmit an electrical signal, a coaxial connector should ensure that a reliable electrical connection is achieved between the outer body of the connector and the outer conductor of the coaxial cable. Likewise, a suitable coaxial connector must achieve a reliable electrical connection between the conductive pin of the connector and the center conductor of the coaxial cable. In addition, reliable coaxial connectors must form a secure mechanical connection to the end of the coaxial cable, since mechanical separation of the connector from the end of the cable will interfere with successful transmission of the desired electrical signal.

Before attaching the end of a coaxial cable to a connector, the end of the coaxial cable must be prepared. This is typically done by cutting the dielectric and the outer conductor of the cable for a short distance to expose a short segment of the center conductor. The braided metallic strands of the outer conductor may be folded over the jacket while the conductive foil remains bonded to the dielectric.

Once the coaxial cable is prepared, the prepared end is inserted into the connector until the dielectric material and conductive foil engages the insulator and the center conductor engages the conductive pin. Previous insulators typically only have a shoulder or an inner chamfer where the dielectric material and conductive foil meets the insulator. In these types of insulators, the conductive foil can become diverted inwardly toward the center conductor during installation. When the conductive foil is diverted inwardly towards the center conductor, it can affect the impedance matching of the connector or cause a signal short if the conductive foil contacts the center conductor. This in turn affects performance parameters, such as return loss or a failure to transmit the desired electrical signal.

It would be a great advantage to provide an insulator for coaxial cable connectors that overcomes the above problems and disadvantages.

SUMMARY OF THE INVENTION

Briefly stated, an insulator for a coaxial cable connector, the insulator extending along a longitudinal axis and having defined therein an insulator passageway, the insulator having a first end and a second end, the first end of the insulator having a guide surface defined thereon, whereby the guide surface terminates at the first end at a projection.

According to an embodiment of the invention, a connector for a coaxial cable, the coaxial cable having a center conductor surrounded by a dielectric material, the dielectric material surrounded by a conductive foil sheath, the connector comprising: a connector body having a first end and a second end, the connector body extending along a longitudinal axis and having defined therein an internal passageway; and, an insulator disposed within the internal passageway, the insulator having an insulator passageway configured to receive the center conductor, the insulator further having a insulator first end and an insulator second end, the insulator first end having a guide surface defined thereon, the guide surface configured to radially divert the conductive foil sheath away from the center conductor.

According to an embodiment of the invention, a method for attaching a coaxial cable to a connector, the coaxial cable having a center conductor surrounded by a dielectric material, the dielectric surrounded by a conductive foil sheath, the connector having an internal passageway defined therein, the connector further having an insulator having a guide surface defined at one end, the insulator disposed within the internal passageway, the insulator having an insulator passageway, comprising the steps of: inserting the cable into the internal passageway, whereby a portion of the center conductor is disposed in the insulator passageway; engaging the dielectric with the guide surface configured to radially divert the conductive foil sheath away from the center conductor.

According to an embodiment of the invention, a connector for a coaxial cable, the coaxial cable having a center conductor surrounded by a dielectric material, the dielectric material surrounded by a conductive foil sheath, the connector comprising: a connector body having a first end and a second end, the connector body having defined therein an internal passageway; and, an insulator disposed within the internal passageway, the insulator having an insulator passageway configured to receive the center conductor, the insulator further having a first end and a second end, the first end having a first inner diameter and a first outer diameter, an guide surface defined between the first inner diameter and the first outer diameter, the guide surface configured to radially divert the conductive foil sheath away from the center conductor; a conductive pin partially disposed within the insulator passageway, the conductive pin configured to receive the center conductor; a post disposed within the internal passageway, the post having a post passageway configured to receive the coaxial cable; and, a compression sleeve positioned at the first end of the connector body for engagement with the post, the compression sleeve having a compression sleeve passageway configured to receive the coaxial cable, wherein axial advancement of the compression sleeve causes a deformable sleeve to radially inwardly compress the coaxial cable against the post.

Other objects and features of the invention will become apparent as the description proceeds, especially when taken in conjunction with the accompanying drawings illustrating the invention.

DESCRIPTION OF THE DRAWINGS

FIG. 8 shows a cross-section of an insulator in accordance with an embodiment of the present invention.

FIG. 8A shows an detailed view of a concave guide surface circled in FIG. 8 in accordance with an embodiment of the present invention.

FIG. 8B shows an expanded view of a ramped guide surface circled in FIG. 8 in accordance with an embodiment of the present invention.

FIG. 8C shows an expanded view of a tapered guide surface circled in FIG. 8 in accordance with an embodiment of the present invention.

FIG. 8D shows an expanded view of a concave guide surface circled in FIG. 8 in accordance with an embodiment of the present invention.

DESCRIPTION OF THE PREFERRED EMBODIMENT(S)

Figure 1A:
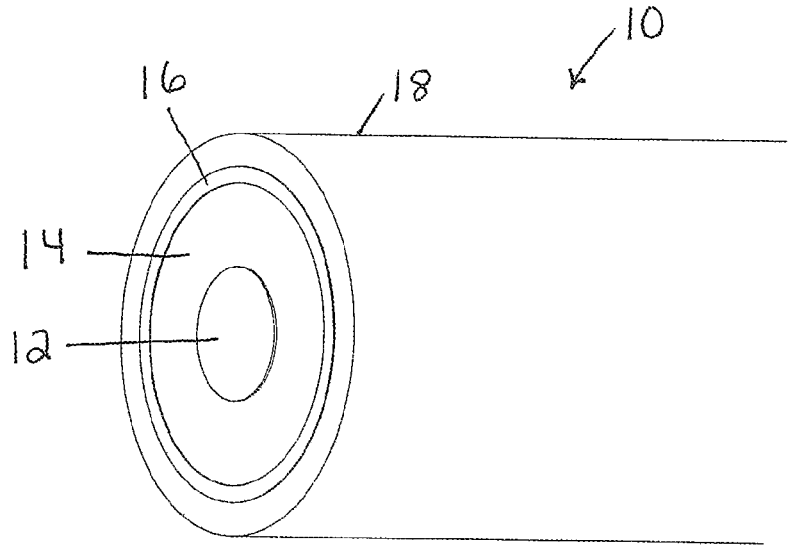
FIG. 1A depicts a perspective view of a coaxial cable prior to preparation.

Reference will now be made in detail to the present preferred embodiments of the invention, examples of which are illustrated in the accompanying drawings. Whenever possible, the same reference numerals will be used throughout the drawings to refer to the same or like parts for clarity.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment(s) of the invention; however, concepts, as based upon the description, may be employed in other embodiments without departing from the scope of the inventions.

Figure 1B:
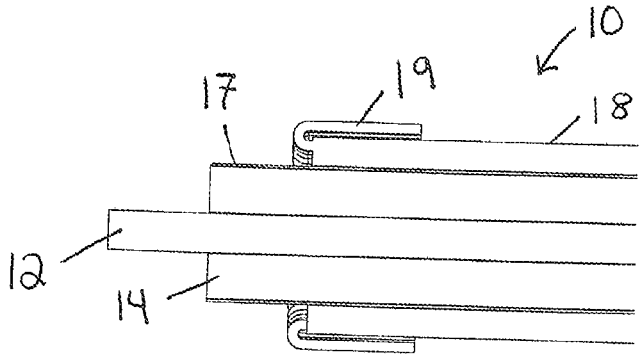
FIG. 1B depicts a cross-section of a coaxial cable, where an end has been prepared for engagement with a connector.
Figure 2:
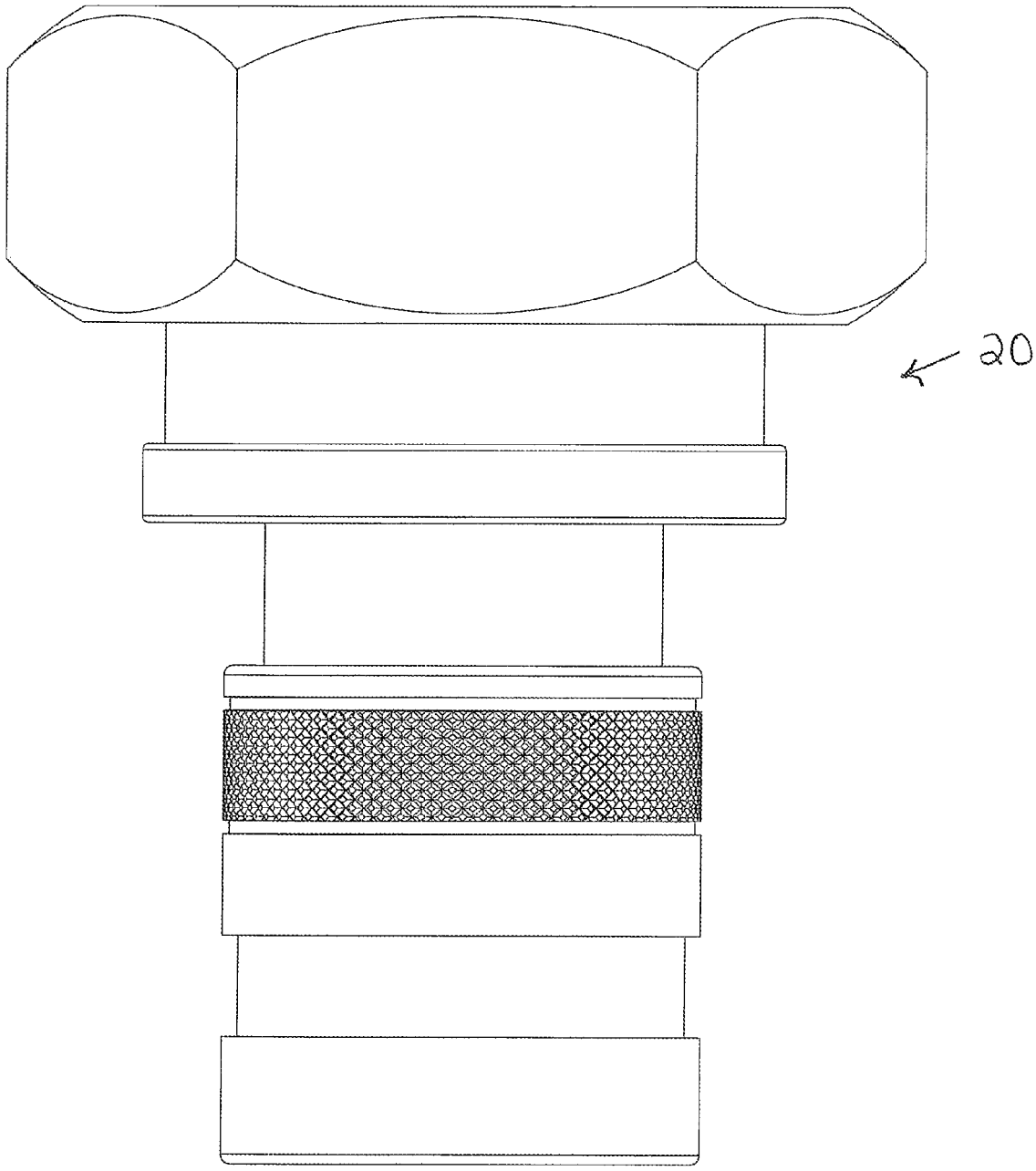
FIG. 2 depicts a side elevation view of a connector.
Figure 3:
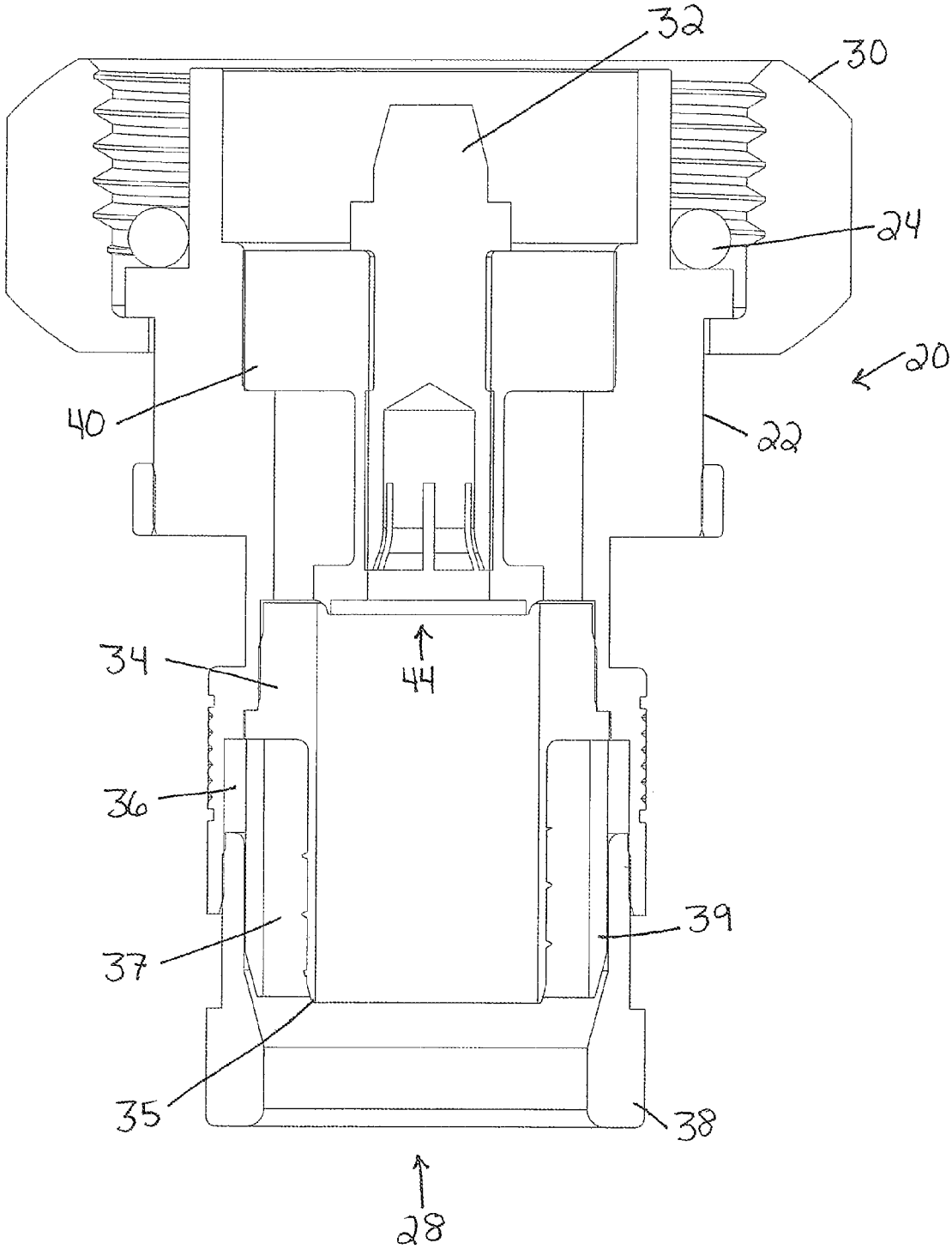
FIG. 3 depicts a cross-section view of the connector of FIG. 2.

With reference to FIG. 1A, a coaxial cable 10 is shown prior to preparation for installation into a coaxial cable connector 20 (See FIGS. 2 and 3). Coaxial cable 10 includes a center conductor 12, typically formed of copper, copper-clad steel or aluminum, which is surrounded by a low dielectric constant, insulator material 14, such as plastic foam and the like. An outer conductor 16 typically is bonded to the outer surface of and thereby contains the dielectric 14 and embedded center conductor 12. Outer conductor 16 can comprise a sheath of fine braided metallic strands, a metallic foil, or multiple layer combinations of either or both. FIG. 1B shows a multiple layer combination where outer conductor 16 has a metallic conductive foil 17 and fine braided metallic strands 19. A flexible, plastic jacket 18 surrounds outer conductor 16 to seal the cable from the environment and provide additional stiffness and mechanical protection to cable 10.

FIG. 1B shows the typical preparation of the end of cable 10 prior to insertion into a coaxial cable connector by selectively removing various layers to progressively expose an end of center conductor 12, an end of dielectric 14 and an end of the conductive foil 17. A portion of braided metallic strands 19 has been folded back over jacket 18.

FIG. 2 shows a typical 7/16 inch DIN male type coaxial cable connector 20. The selection of this particular type of connector is for illustrative purposes only, and it is understood by one of ordinary skill in the art that a particular type of connector is not required for the present invention.

FIG. 3 is a cross-section of connector 20 shown in FIG. 2. Connector 20 includes a connector body 22 with an internal passageway 28 for receiving cable 10. A nut 30 is connected to connector body 22 via an annular flange. An o-ring 24 disposed between nut 30 and connector body 22 provides a seal to prevent moisture, dust, and the like from entering the connector. An insulator 40 positions and holds a conductive pin 32 within connector body 22. Insulator 40 may have an internal passageway 44 for receiving conductive pin 32. Conductive pin 32 receives center conductor 12 upon installation of cable 10 and establishes electrical conductivity between the center conductor and the mating port (not shown).

With further reference to FIG. 3, connector 20 includes a post 34 configured to receive the center conductor 12, dielectric 14 and conductive foil 17 of cable 10. Tip 35 of post 34 is configured to pass between the conductive foil 17 and the braided metallic strands 19. A portion of braided metallic strands 19 and jacket 18 fits into cavity 37. During installation, compression sleeve 38 is axially advanced into cavity 36 and is configured to compress a deformable sleeve 39. Deformable sleeve 39 compresses braided metallic strands 19 and jacket 18 against post 34, thereby securing the cable in the connector.

Figure 4:
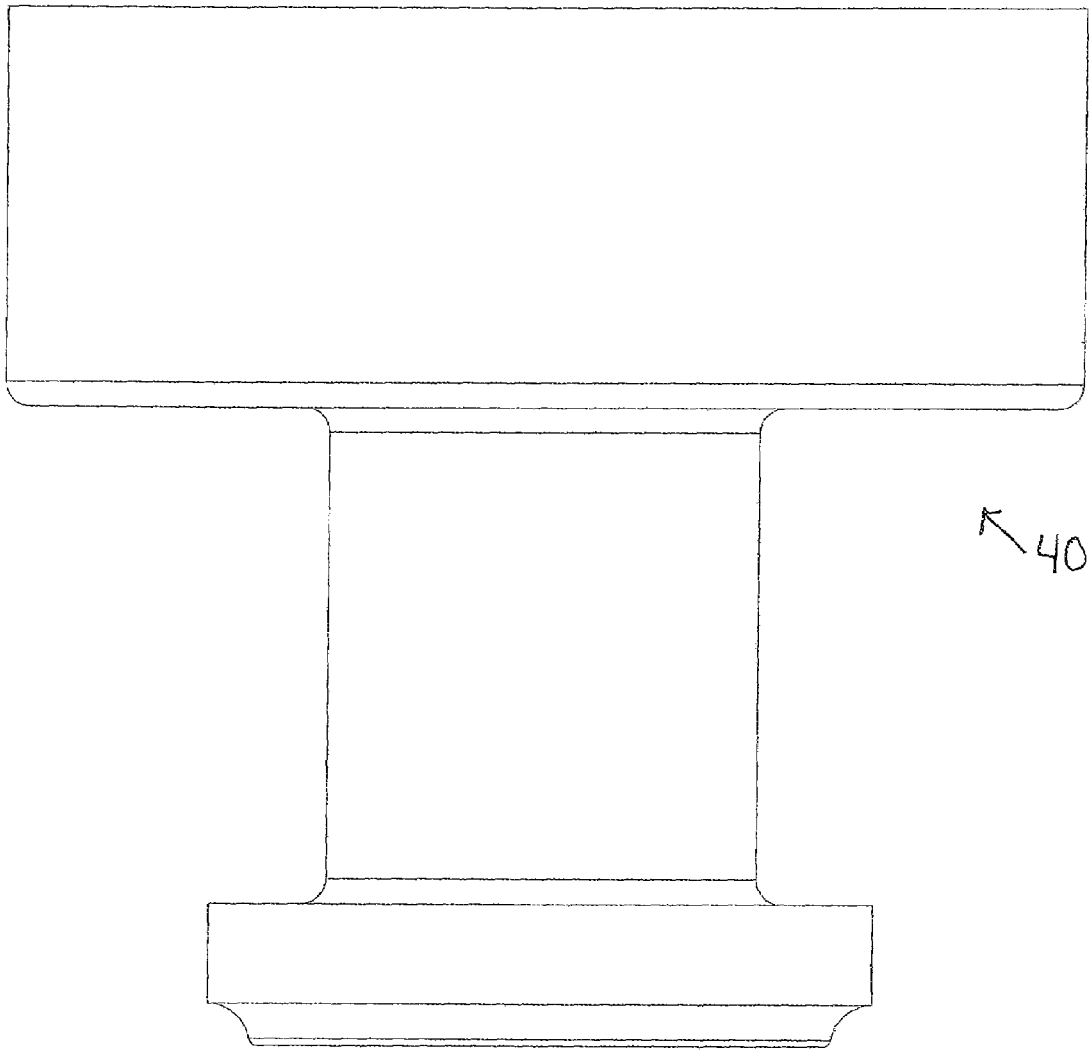
FIG. 4 depicts a side elevation view of an insulator with one embodiment of a guide surface.
Figure 5:
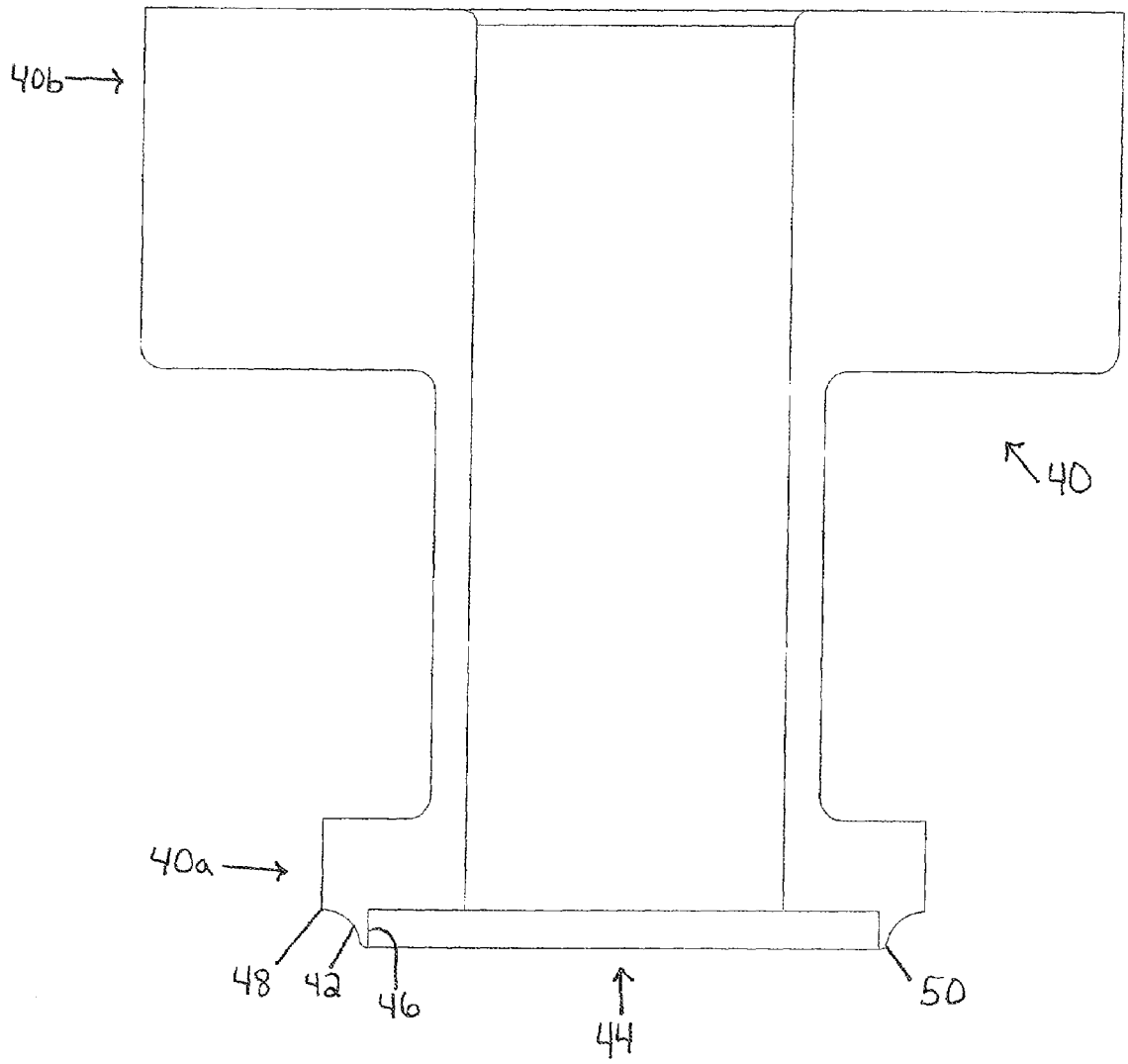
FIG. 5 depicts a cross-section view of the insulator of FIG. 4.

With reference to FIGS. 4 and 5, a side elevation and cross-sectional view of insulator 40 is shown. Insulator 40 has a first end 40*a* and a second end 40*b*. Insulator 40 includes an insulator passageway 44 for receiving the conductive pin 32. Insulator first end 40*a* includes an insulator first inner diameter 46 and an insulator first outer diameter 48, with a guide surface 42 formed in-between. Guide surface 42 may terminate at one end at a projection 50.

Figure 6:
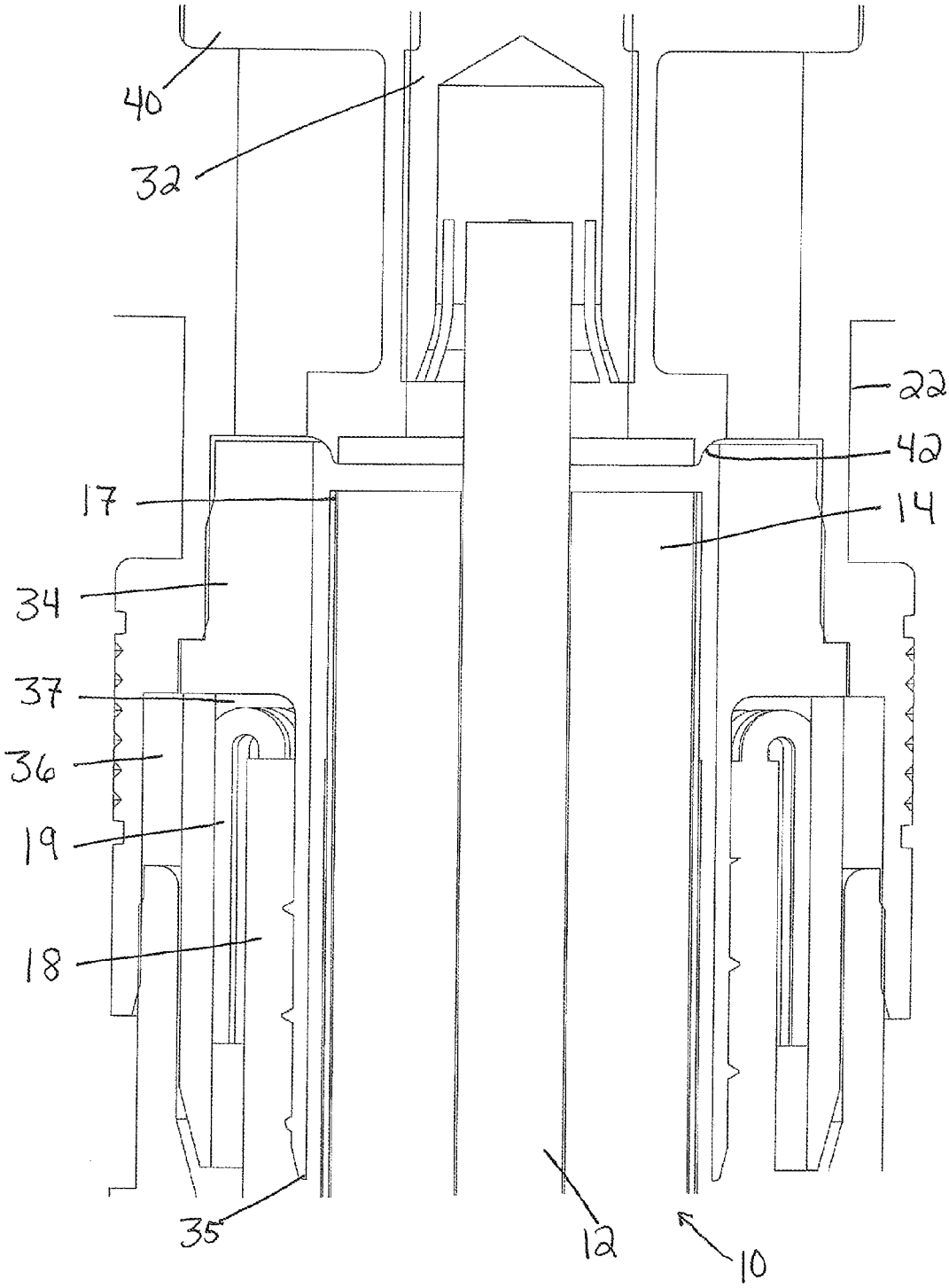
FIG. 6 depicts a cross-section of a coaxial cable partially installed in the connector of FIG. 2.
Figure 7:
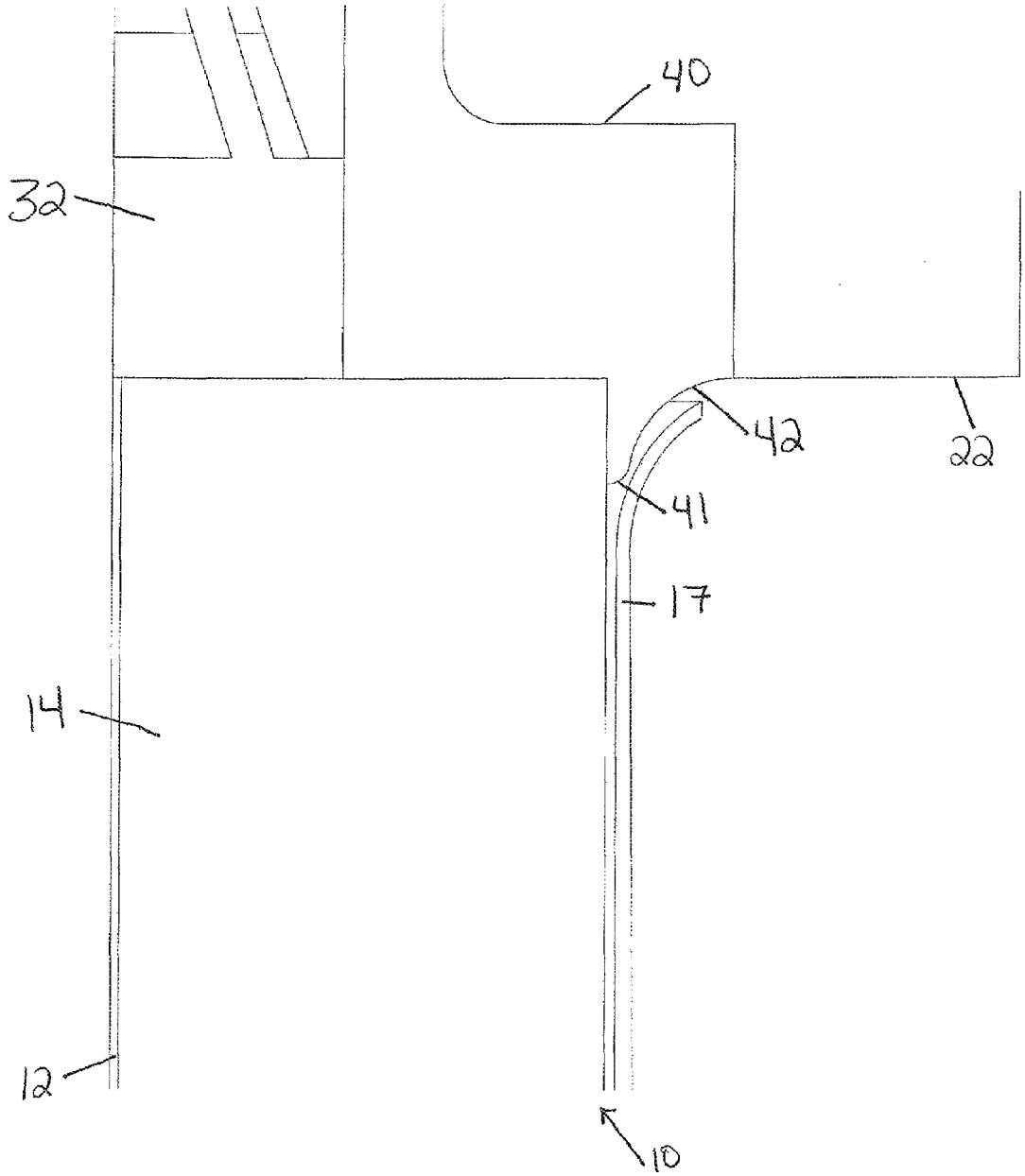
FIG. 7 depicts a cross-section of a coaxial cable installed in the connector of FIG. 2.

Referring to FIG. 6, the prepared end of cable 10 has been partially inserted into connector 20 having insulator 40 with one embodiment of a guide surface 42. As cable 10 is fully inserted into connector 20 (See FIG. 7), the portion 41 of guide surface 42 engages the dielectric 14, causing a portion of the dielectric 14 to bend or deform slightly. The slight bending or deformation of a portion of dielectric 14 radially diverts the conductive foil 17 away from the center conductor. This radial diversion of the conductive foil 17 occurs prior to the compression sleeve 38 being advanced into the connector body 20.

Referring to FIG. 8, guide surface 42 may take various forms, including a ramped or tapered surface, or various shapes such as convex or arcuate. FIG. 8A shows an arcuate surface, FIG. 8B shows a ramped surface, FIG. 8C shows a tapered surface, and FIG. 8D shows a convex surface.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

We claim:

1. A connector for a coaxial cable, the coaxial cable having a center conductor surrounded by a dielectric material, the dielectric surrounded by a conductive foil sheath, the connector comprising:

a connector body having a first end and a second end, the connector body extending along a longitudinal axis and having defined therein an internal passageway; and, an insulator disposed within the internal passageway, the insulator having an insulator passageway configured to receive the center conductor, the insulator further having an insulator first end and an insulator second end, the insulator first end having a guide surface defined thereon, wherein insertion of the coaxial cable into the internal passageway causes the guide surface to engage the dielectric and radially divert the conductive foil sheath away from the center conductor.

2. The connector of claim 1, wherein the guide surface terminates at one end at a projection.

3. The connector of claim 2, wherein the guide surface is arcuate.

4. The connector of claim 2, wherein the guide surface is convex.

5. The connector of claim 2, wherein the guide surface is ramped.

6. The connector of claim 2, wherein the guide surface is tapered.

7. The connector of claim 1, wherein the guide surface is defined between a first insulator inner diameter and a first insulator outer diameter.

8. The connector of claim 1, wherein the connector further comprises:

a nut operatively attached to the second end of the connector body; and, a conductive pin partially disposed within the insulator passageway, the conductive pin configured to receive the center conductor.

9. The connector of claim 8, wherein the connector further comprises:

a post disposed within the internal passageway, the post having a post passageway configured to receive the coaxial cable; and, a compression sleeve positioned at the first end of the connector body for engagement with the post, the compression sleeve having a compression sleeve passageway configured to receive the coaxial cable, wherein axial advancement of the compression sleeve causes a deformable sleeve to radially inwardly compress the coaxial cable against the post.

10. The connector of claim 1, wherein the insulator has an outer surface of varying diameters.

11. The connector of claim 1, wherein the insulator is generally circular in cross-section about the longitudinal axis.

12. An insulator for coaxial cable, the coaxial cable having a center conductor surrounded by a dielectric material, the dielectric surrounded by a conductive foil sheath, the insulator extending along a longitudinal axis and having defined therein an insulator passageway, the insulator passageway having a first end and a second end, the first end of the insulator having a guide surface defined thereon, the guide surface terminating at the first end at a projection, wherein engagement of the dielectric with the guide surface causes the conductive foil sheath to radially divert away from the center conductor.

13. The insulator of claim 12 wherein the guide surface is defined between a first insulator inner diameter and a first insulator outer diameter.

14. The insulator of claim 12, wherein the guide surface is arcuate.

15. The insulator of claim 12, wherein the guide surface is convex.

16. The insulator of claim 12, wherein the guide surface is ramped.

17. The insulator of claim 12, wherein the guide surface is tapered.

18. The insulator of claim 12, wherein the insulator has an outer surface of varying diameters.

19. The insulator of claim 12, wherein the insulator is generally circular in cross-section about the longitudinal axis.

20. A method for attaching a coaxial cable to a connector, the coaxial cable having a center conductor surrounded by a dielectric material, the dielectric surrounded by a conductive foil sheath, the conductive foil sheath surrounded by braided metallic strands, the braided metallic strands surrounded by a jacket, the connector having an internal passageway defined therein, the connector further having an insulator having a guide surface defined at one end, the insulator disposed within the internal passageway, the insulator having an insulator passageway, comprising the steps of:

removing a portion of the jacket, braided metallic strands, conductive foil sheath and dielectric of the coaxial cable to expose a portion of the center conductor;

folding a portion of the braided metallic strands back over the jacket;

inserting the coaxial cable into the internal passageway, whereby a portion of the center conductor is disposed in the insulator passageway; and, engaging the dielectric with the guide surface and causing the conductive foil sheath to radially divert away from the center conductor.

21. A connector for a coaxial cable, the coaxial cable having a center conductor surrounded by a dielectric material, the dielectric surrounded by a conductive foil sheath, the connector comprising:

a connector body having a first end and a second end, the connector body having defined therein and internal passageway;

an insulator disposed within the internal passageway, the insulator having an insulator passageway configured to receive the center conductor, the insulator further having an insulator first end and an insulator second end, the insulator first end having a first inner diameter and a first outer diameter, a guide surface defined between the first inner diameter and the first outer diameter, wherein engagement of the dielectric with the guide surface causes the conductive foil sheath to radially divert away from the center conductor;

a conductive pin partially disposed within the insulator passageway, the conductive pin configured to receive the center conductor;

a post disposed within the internal passageway, the post having a post passageway configured to receive the coaxial cable; and, a compression sleeve positioned at the first end of the connector body for engagement with the post, the compression sleeve having a compression sleeve passageway configured to receive the coaxial cable, wherein axial advancement of the compression sleeve causes a deformable sleeve to radially inwardly compress the coaxial cable against the post.

22. The connector of claim 21, wherein the guide surface terminates at one end at a projection.

* * * * *